United States Patent [19]

Rueb

[11] 4,249,349

[45] Feb. 10, 1981

[54] ELONGATE SANDING BLOCK

[75] Inventor: John T. Rueb, Saint Paul, Minn.

[73] Assignee: Minnesota Mining and Manufacturing Company, St. Paul, Minn.

[21] Appl. No.: 958,101

[22] Filed: Nov. 6, 1978

[51] Int. Cl.[3] ..... B24P 15/00

[52] U.S. Cl. ..... 51/392

[58] Field of Search ..... 51/205, 391–393; 29/78; 145/24, 25; 30/168, 169; 254/104; 132/76.4; D8/47, 90, 91, 94; 17/19

[56] References Cited

U.S. PATENT DOCUMENTS

| | | | |
|---|---|---|---|
| D. 225,720 | 1/1973 | Coon | D8/90 |
| 289,879 | 12/1883 | Almond | 51/392 |
| 454,956 | 6/1891 | Levy | 132/76.4 |
| 953,171 | 3/1910 | Kraeuter | 30/169 |
| 1,434,744 | 11/1922 | Hibbler | 30/169 |
| 1,864,616 | 6/1932 | Rayner | 51/205 R |
| 2,103,320 | 12/1937 | Corff | 51/392 |
| 2,347,856 | 5/1944 | Wachter | 51/392 |
| 2,838,057 | 6/1958 | Smith | 132/76.4 |
| 3,389,447 | 6/1968 | Theobald et al. | 29/78 |

*Primary Examiner*—Harold D. Whitehead
*Assistant Examiner*—K. Bradford Adolphson
*Attorney, Agent, or Firm*—Cruzan Alexander; Donald M. Sell; William L. Huebsch

[57] ABSTRACT

A sanding block having a handle portion from which projects an elongate support portion to which can be adhered a strip of pressure-sensitive adhesive-coated finishing material. The support portion has various shaped surface portions for supporting the finishing material, including a planar surface portion, an arcuate surface portion of decreasing radius extending longitudinally of the support portion away from the handle portion, and an edge surface portion provided by planar surface portions intersecting at an acute included angle so that the finishing material may be supported in a desired shape that affords pressing and rubbing it against a complementary surface on a workpiece by manual manipulation of the sanding block.

4 Claims, 7 Drawing Figures

ELONGATE SANDING BLOCK

BACKGROUND OF THE INVENTION

This invention relates to sanding blocks of the type having a surface adapted to have adhered thereto a piece of pressure-sensitive adhesive-coated finishing material (e.g., sandpaper) and a handle so that the sanding block can be manually manipulated to press and rub the finishing material against a surface to be finished. The prior art is replete with such sanding blocks. Known sanding blocks of this type, however, have only a planar surface to which the finishing material may be adhered. Thus while such sanding blocks provide proper support for rubbing finishing materials against planar surfaces, they do not facilitate finishing surfaces in radiused corners, grooves or openings in the workpiece being finished.

SUMMARY OF THE INVENTION

According to the present invention, there is provided an elongate file-like sanding block which provides a plurality of differently shaped surface portions over which pressure sensitive adhesive coated finishing material such as sandpaper may be adhered so that one surface portion can be selected by which finishing material can be pressed and rubbed against either an outer planar surface on a workpiece, or a concave planar or cylindrically convex surfaces in a corner, groove or opening in the workpiece.

The sanding block according to the present invention is elongate, has a handle portion adjacent one end adapted for manual engagement to manipulate the sanding block, and a support portion projecting from the handle portion having a plurality of differently shaped elongate surface portions adapted to support the pressure sensitive adhesive coated finishing material. These surface portions include a planar surface portion which is useful for supporting finishing material to rub it against a planar surface on a workpiece to be finished; an arcuate surface portion having a smoothly decreasing radius about an axis extending generally longitudinally of the tool away from its handle portion which arcuate surface portion is useful for supporting finishing material to rub it against a cylindrically concave surface on a workpiece to be finished; and an edge surface portion around which finishing material may be supported provided by planar surfaces intersecting at an acute included angle, which edge surface portion is useful for supporting finishing material to rub it against planar or convex surfaces in grooves on a workpiece to be finished.

Preferably the arcuate surface portion should provide a wide range of radiuses to accommodate the various concave surfaces encountered on workpieces, with a suitable range for the arcuate surface including radiuses from about 0.38 cm. (0.15 inch) to about 2.70 cm. (1.06 inch). Also the acute included angle between the intersecting surfaces should be less than 90 degrees (e.g., no more than about 85 degrees and preferably about 60 degrees) to afford access to planar or convex surfaces in a wide variety of grooves and corners.

Also, preferably, the sanding block has an end part opposite the handle portion which is very thin in a direction normal to the planar surface portion so that the ends of the planar, radiused and edge surface portions on the thin end part of the tool can be inserted into small openings in workpieces being finished to finish the surfaces defining those openings.

BRIEF DESCRIPTION OF THE DRAWING

The present invention will be further described with respect to the accompanying drawing wherein like numerals refer to like parts throughout the several views and wherein.

DESCRIPTION OF THE PREFERRED EMBODIMENT

Figure 1:
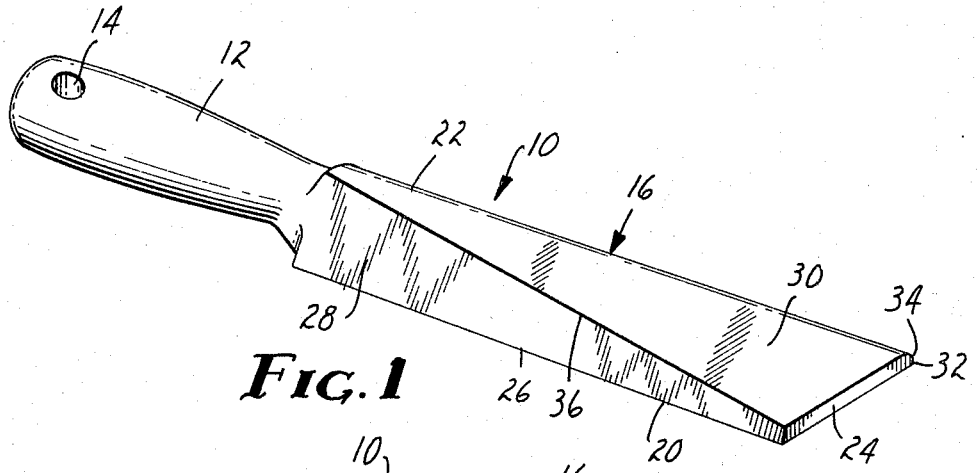
FIG. 1 is a perspective view of an elongate sanding block according to the present invention.
Figure 2:
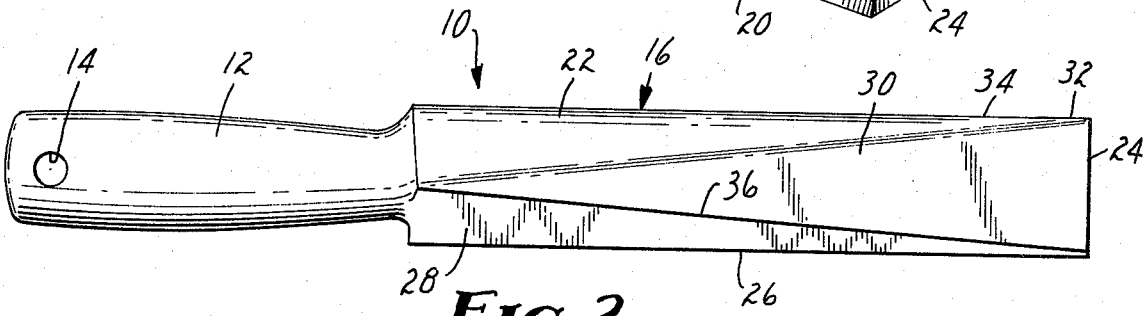
FIG. 2 is a top view of the elongate sanding block of FIG. 1.
Figure 3:
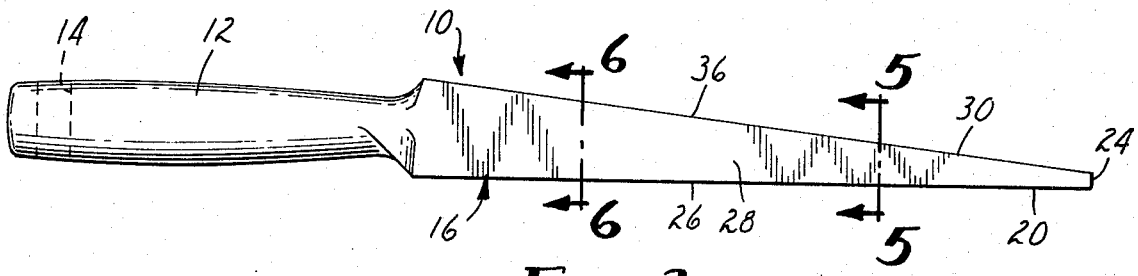
FIG. 3 is a front side view of the elongate sanding block as illustrated in FIG. 1.

Referring now to the drawing, there is illustrated an elongate file-like sanding block according to the present invention generally designated by the reference numeral 10.

Figure 4:
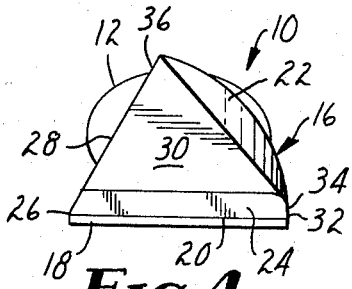
FIG. 4 is an end view of the elongate sanding block of FIG. 1 which additionally shows a piece of finishing material adhered over a planar surface portion on the sanding block.
Figure 5:
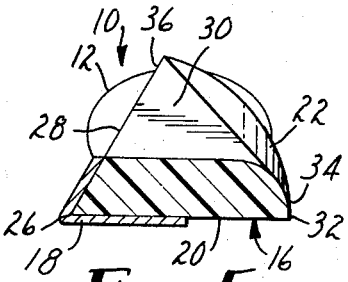
FIG. 5 is a sectional view taken approximately along line 5—5 of FIG. 3 and which additionally shows a piece of finishing material adhered over an edge surface on the sanding block.
Figure 6:
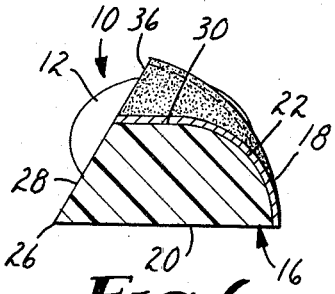
FIG. 6 is a sectional view taken approximately along line 6—6 of FIG. 3 and which additionally shows a piece of finishing material adhered over an arcuate surface portion of the sanding block.
Figure 7:
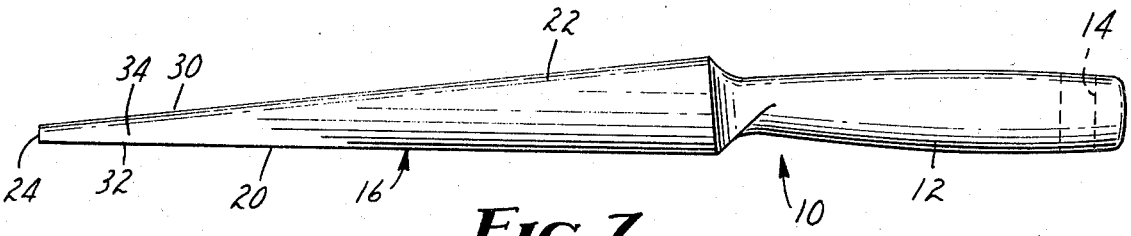
FIG. 7 is a rear side view of the elongate sanding block as illustrated in FIG. 1.

The sanding block 10 includes a handle portion 12 adjacent one end which is shaped for manual engagement to manipulate the sanding block 10 and has a through opening 14 to facilitate hanging the sanding block 10 for storage; and an elongate support portion 16 projecting from the handle portion 12 which has a plurality of differently shaped longitudinally extending surface portions adapted to support pressure sensitive adhesive coated finishing material 18 (FIGS. 4, 5, and 6) to afford pressing and rubbing the finishing material 18 against generally complementary surfaces on a workpiece to be finished.

Included in the differently shaped surface portions are:

(1) a rectangular first planar surface portion 20 adapted to support finishing material 18 (FIG. 4) so that it can be uniformly pressed and rubbed against outer planar portions of a workpiece;

(2) an arcuate surface portion 22 having a smoothly decreasing radius about an axis extending generally longitudinally of the tool 10 from its handle portion 12 toward its opposite distal end 24, which arcuate surface portion 22 is adapted to support finishing material 18 (FIG. 6) so that it can be pressed and rubbed against cylindrically concave surfaces on a workpiece to be finished; and (3) an edge surface portion 26 provided by a second planar surface portion 28 intersecting the first planar surface portion 20 at a longitudinally extending edge of the block, which edge surface portion 26 is adapted to support finishing material 18 (FIG. 5) so that it can be pressed and rubbed against planar or convex surfaces in grooves on the workpiece.

Also the support portion 16 is shaped to provide a thin end part adjacent its distal end 24 which end part can be inserted into openings in or between closely spaced portions of a workpiece to be finished to facilitate finishing the walls thereof. The support portion 16 has a triangular third planar surface portion 30 on its side opposite the first planar surface portion 20 which is disposed with respect to the first planar surface portion 20 so that the first and third planar surface portions 20 and 30 converge toward the distal end 24 of the support portion 16, ordinates of the first and third planar surface portions 20 and 30 transverse of the sanding block 10 are parallel, and the distal end 24 of the sanding block 10 has a substantially greater width (e.g., 3.81 cm. or 1.5 inch) parallel to the planar surface portions 20 and 30 than thickness (e.g., 0.63 cm. or 0.25 inch) between the first and third planar surface portions 20 and 30.

The arcuate surface portion 22 is disposed along one edge of the third planar surface portion 30 and blends smoothly with it on one side, while the other side of the arcuate surface portion 22 intersects an adjacent edge 32 of the first surface portion 20 along a portion of the arcuate surface portion 22 adjacent the handle portion 12, and along the rest of the arcuate surface portion 22 blends smoothly with a fourth planar surface portion 34 that intersects that adjacent edge 32 of the rectangular surface portion 20 at an angle of about 90 degrees. Thus the arcuate surface portion 22 subtends an angle of around 90 degrees along its entire length.

The second planar surface portion 28 intersects the third planar surface portion 30 along an edge 36 at an obtuse angle (e.g., about 150 degrees), which intersection provides an obtuse edge surface that could also provide utility for supporting finishing material for some applications.

Both (1) the rectangular planar surface portion and (2) the arcuate surface portion 22 plus its flanking third and fourth planar surface portions 30 and 34 have corresponding widths and lengths (e.g., a width of about 3.8 cm. or 1.5 inches and a length of about 19 cm. or 7.5 inches), which is convenient for the application of correspondingly sized finishing material 18 to these areas of the tool 10.

The elongate sanding block 10 has a surface finish affording sufficient adhesion of the pressure sensitive adhesive commonly used on finishing materials so that the finishing material will be retained in place as it is manipulated over a surface to be finished via the sanding block, but not so much adhesion that the finishing material can not be cleanly separated from the surface of the sanding block 10 without delaminating or tearing the finishing material 18. It has been found that blow-molded, high impact polystyrene provides such a surface.

To use the tool a workman selects a surface portion of the support 16 of the sanding block 10 which complements the surface of the workpiece desired to be finished and applies thereto a strip of pressure sensitive adhesive coated finishing material 18. He then engages the handle portion 12 of the sanding block 10 to manually manipulate the adhered finishing material 18 against the surface of the workpiece to produce the desired finish, after which the used finishing material 18 may be peeled away.

What is claimed is:

1. A sanding block comprising a handle portion, and an elongate support portion projecting from the handle portion having a plurality of longitudinally extending smooth surfaces adapted to have pressure sensitive adhesive coated finishing material adhered thereto, said surfaces including a first rectangular planar surface, a second planar surface intersecting said first surface at an acute included angle, a third planar surface on the side of said support portion opposite said first planar surface, said first and third planar surfaces converging toward an end of said support portion opposite said handle portion and being so disposed that ordinates of said first and third planar surfaces transverse of said support portion are parallel and that said end has a substantially greater width parallel to said first planar surface than thickness between said first and third planar surfaces; and an arcuate surface intersecting the side of said first surface opposite said second surface and smoothly converging with said third planar surface along the edge of said third planar surface opposite said second planar surface, said arcuate surface having a smoothly decreasing radius about an axis extending generally longitudinally of said support portion away from said handle portion.

2. A sanding block according to claim 1 wherein said radius smoothly decreases from about 2.6 centimeters to about 0.37 centimeters.

3. A sanding block according to claim 1 wherein the distance along the surface of said sanding block from the intersection of said second and third planar surfaces around said arcuate surface to the adjacent edge of said first planar surface is generally uniform along the length of said support portion and is generally equal to the width of said first planar surface.

4. A sanding block according to claim 1 wherein said first planar surface has a width of about 3.8 cm. and a length of about 19 cm.

* * * * *